US007043806B2

(12) United States Patent
Schröck et al.

(10) Patent No.: US 7,043,806 B2
(45) Date of Patent: May 16, 2006

(54) RADIAL PRESS FOR PRESSING ROTATIONALLY SYMMETRICAL HOLLOW BODIES

(75) Inventors: Peter Schröck, Weinheim (DE); Ursula Schröck-Horn, Weinheim (DE)

(73) Assignee: Von Waitzische Beteillgungen, GBR, represented by the Gesellschafter Harald Von Waitz und Dr. Freidrich Von Waitz, Kassel (DE)

( * ) Notice: Subject to any disclaimer, the term of this patent is extended or adjusted under 35 U.S.C. 154(b) by 93 days.

(21) Appl. No.: 10/925,227

(22) Filed: Aug. 24, 2004

(65) Prior Publication Data

US 2005/0061052 A1 Mar. 24, 2005

(30) Foreign Application Priority Data

Aug. 27, 2003 (DE) ..... 103 39 291

(51) Int. Cl.
*B23P 19/04* (2006.01)

(52) U.S. Cl. ..... 29/237; 29/282

(58) Field of Classification Search ..... 29/237, 29/282, 235, 280; 72/402, 452.6, 453.16
See application file for complete search history.

(56) References Cited

U.S. PATENT DOCUMENTS

| | | | | | |
|---|---|---|---|---|---|
| 4,989,443 | A | * | 2/1991 | Sawdon | 72/402 |
| 5,257,525 | A | * | 11/1993 | Clarke | 72/402 |
| 5,323,697 | A | * | 6/1994 | Schrock | 100/232 |
| 5,890,270 | A | * | 4/1999 | Oetiker | 29/235 |
| 6,324,884 | B1 | * | 12/2001 | Barjesteh et al. | 72/402 |
| 6,484,552 | B1 | * | 11/2002 | Bernas et al. | 72/402 |

* cited by examiner

*Primary Examiner*—Lee D. Wilson
(74) *Attorney, Agent, or Firm*—Fulbright & Jaworski L.L.P.

(57) ABSTRACT

A radial press has a press frame with press yokes movable relative to one another. The press yokes have on each side of a dividing gap (T) a recess with initial slide surfaces on which at least two supports situated displaceably opposite one another relative to the gap (T). The first slide surfaces for the displaceable supports are aligned parallel to one another and perpendicular to a pressing direction (P). Two of the oppositely lying support bodies can be displaced by a wedge-shaped thrusting body which can move parallel to the dividing gap (T), the thrusting body being mounted in the recesses between two second slide surfaces, the second slide surfaces forming an angle between them. The angle is chosen such that the path of the thrusting body parallel to the dividing gap (T) is of the same magnitude as the pressing stroke of the press yokes perpendicular thereto.

22 Claims, 11 Drawing Sheets

RADIAL PRESS FOR PRESSING ROTATIONALLY SYMMETRICAL HOLLOW BODIES

FIELD OF THE INVENTION

This application claims priority from German 103 39 291.2-14 filed Aug. 27, 2003, incorporated herein by reference.

The invention relates to a radial press.

BACKGROUND AND SUMMARY OF THE INVENTION

The term, "hollow workpieces" is to be understood as shell-like workpieces with external cross sections in the form of circles and regular polygons such as hexagonal and octagonal profiles. The workpiece's outer surfaces in the axial direction can be rectilinear, conical, hollow (barrel-shaped) or stepped. Such workpiece surfaces can be dealt with by shaping the preferably exchangeable press jaws with appropriate pressing faces.

A special application for which the subject of the application is especially suitable is the joining of hose fittings consisting of high-strength metal (e.g., steel) to flexible hoses. The hose in such cases consists substantially of a section of tubing onto the ends of which thick-walled press fittings are to be placed. Onto the ends nipples are mounted which are provided with connecting pieces, such as, for example, those provided with terminal pieces such as, e.g., pieces with internal or external screw threads, flange plates, elbows, pipe bends, elbows, wyes, etc., which extend from the hose ends.

Hose lines of such complex formation are also referred to as "combination hose and pipe (or tube) fittings." For reasons of safety and economy their components should not be screwed together but should be pressed inseparably together.

The inner parts—the so-called nipples—support the hose walls on the inside during the pressing operation and thereafter. In the case of the outer parts, the sleeves, their cladding diameters are reduced by the pressing faces of a pressing machine until the desired final diameter is reached, in which case not only long press strokes must be performed, but also the pressing forces increase progressively. At the same time the pressing procedures in small and large-scale production must be performed with high dimensional and repeatable accuracy, since in the case of the hoses, which must sustain pressures of up to 1000 bar (100 MPa) and more, often involve components relevant to safety whose failure and breakdown can cause immense expense and personal and environmental damage.

In addition, such hose, pipe and fitting combinations are becoming increasingly complex in design due to the constant progress of the art. Machines and apparatus which are becoming increasingly compact reduce the bulk of such hose and fitting combinations, so that their designers are increasingly confronted with new problems in installing in narrow spaces tubes and fitting combinations which are true to specifications and perfect in operation. They have found that modem, computer-controlled bending machines are an indispensable aid if they can be used to produce complex expansion loops with multiple bends quickly, precisely and economically, even in small series. In the case of expansion loops, they can be of the kind that have a bend angle of 180 degrees at the minimum possible radius. Such bend radiuses are, for example, equal to the tube diameter.

In the present-day state of the art, the pressing of such hose-and-tube combinations for the high and maximum pressure range, e.g., in the field of hydraulic construction machinery, is not possible if the tube and fitting parts to be pressed extend into the disk-shaped space around the press jaws or press tools. That is because that is where machine parts of the radial presses are located. Because the latter must apply press forces up to 3500 MN, sometimes even more.

Having in mind the above information, the following is set forth on the state of the art.

U.S. Pat. No. 3,744,114 has disclosed a pressing tool indivisible in operation, in which inside of a square standing on one corner, describing the corresponding contact surfaces, eight pressing faces in alternating arrangement around the press axis are distributed to four outer control bodies and four internal press jaws, the axes of symmetry of the outer control bodies form the diagonals of the said square located on the apex. The uppermost control body is joined fixedly with an upper press yoke and the bottommost control body is joined to a lower press yoke. The two lateral control bodies are carried by two vertical plates which are fastened unilaterally on the one hand to the press drive and on the other hand to the press frame, and the two lateral control bodies are supposed to move through slots and guide pins such that all eight pressing faces perform synchronous radial movements. The supporting and moving of the inner press jaws is performed by the fact that the four inner press jaws have at their outer ends, in mirror-image symmetry with their direction of movement, two control surfaces each with an aperture angle of 135 degrees, and that the outer control bodies have on their insides two control surfaces each, complementary therewith. This press tool is not divisible on account of the lateral one-piece control bodies, so that no complexly shaped and/or bulky workpieces can be inserted, but only slender workpieces can be put through it. Many radial presses operate on this principle according today's state of the art, and the press tool has also been made divisible. Then, however, the disadvantage then again arises that the press jaws and/or control bodies spanning the line of separation have to be divided, so that again accuracy suffers.

A radial press with two press yokes and external and internal control bodies has been disclosed by EP 0 539 787 A1 and the corresponding DE 41 35 465 A1, which likewise has eight pressing faces, so that a somewhat more uniform press operation is performed with reduced edge pressures. The planes of symmetry of two of the inner, stationary control bodies run in the direction of the press stroke and the planes of symmetry of the other two inner control bodies run perpendicular thereto. Thus the two last-named inner control bodies overlap a possible line of separation of the press tool, which consequently also is not divisible. Such division, which would make it possible to insert bulky hose fittings, is neither described nor provided or possible. In addition, the press jaw set is enclosed by the press yokes and two tie bars, so that any lateral insertion of bulky hose fittings is impossible for this reason as well.

DE 198 14 474 C1 likewise discloses a radial press. The press tool of which has eight press jaws, each with a pressing face. The control faces in the two press yokes, however, are formed with many bends, and two inner control bodies which can move across them have been replaced by four pressure pieces which are arranged in pairs above and below a line of separation in order to create two tool halves which can be moved far apart in order to permit the insertion of bulky hose fittings. This design however requires a plurality of complexly shaped moving parts with numerous slide surfaces which have to be of high quality. This results in corresponding manufacturing costs. Here, again, the press jaw set is enclosed by the press yokes and two tie bars, so that for this reason, too, the space for lateral insertion of bulky, bent and U-curved hose fittings is lacking. Basically, here again an irregular polygon is involved which forms the control surfaces for four of the press jaws and for the four additional pressing means "standing on one corner." In this case the position of the central axis M of the pressing faces is unchanged. This, however, necessitates the bilateral arrangement of additional press bodies which cover half the distance toward the press gap in the direction of the central axis M.

DE 199 58 103 C1 and the corresponding EP 1 106 276 A2 again disclose a radial press with a divisible press tool with eight pressing surfaces and four control bodies, in which the four control faces in the press yokes, in the axial plan view, are described in effect by a square or rectangle standing on one corner. As practical experiments have shown, even in this case absolutely synchronous paths of the pressing faces can be achieved only at low pressing forces. In the case of high pressing forces and increasing friction losses in the four control bodies, the latter do not run synchronously any longer and the press jaws lying in the line of separation are left behind in the pressing path behind the press jaws arrayed on both sides of the line of separation. A press tube that is to be given a constricted shape is a very unstable object. In the case of a solid cylindrical piece in which no shaping is performed, the press forces of the individual press jaws would distribute themselves evenly. The disadvantage of this state of the art is therefore due to the fact that the four control bodies in their pressing position can be brought into positive connection only through the unstable press sleeve. Consequently, the accuracy of round pressing is not sufficient.

Another considerable disadvantage of such divisible press systems of the state of the art is based on an insufficient press power. Due to the divisibility of the pressing tool and the requirement that the press be loaded from the side, a so-called "open press design" must be chosen, e.g., with a C-shaped press frame or stand. This type exerts a very high bending torque on the yoke of the "C," caused by the pressing force and the axial distance H (see FIG. 14, for example). Only with a heavy and expensive design can this disadvantage be overcome. For reasons of cost, therefore, compromises are made, but they greatly limit the nominal width range of the presses. Such presses have a pressing power of no more than 350 kN, while comparable presses, which are made for closing by lateral tie bars, can apply pressing forces up to 1500 kN. For complex hose-and-tube combinations, as were described in the beginning, this signifies that, for example, only combinations up to the DN 16-4SP nominal width can be pressed instead of those up to DN 32-4SP. Here, therefore, the requirements of high press forces and the possibility of the lateral insertion of the workpieces are diametrically opposed. Heretofore this problem has been worked around by screwing narrow pipe bends with a bend angle of more than 90 degrees onto the hose line. This method of assembly entails leakage risks and requires additional costs. The methods of laying hose-pipe combinations, however, have advanced further, and it is required that these pipe bends have over 90 degrees to 180 degrees. Sometimes even fastening splice pieces onto the pipe bends which are supposed to hold the entire system.

The invention is addressed to the problem of creating a radial press of the kind described above, in which the movements of all pressing faces are made more uniform and the synchronization of the radial press face movement is still further improved from the start to the end of the pressing procedure; the workpieces are to be prevented from worsening any differences in the movements of the individual pressing faces by the reaction forces of surface areas of the workpieces (hollow bodies); furthermore, a radial press of this kind is also to be able to press complexly shaped bent tube patterns onto both ends of the hoses; also, such a press must also be ale to press even greater nominal widths of heavy hose types onto the workpieces (fittings), and finally a radial press of the kind initially described is to be created which requires lower driving forces, is simpler in construction, and has a lower number of slide surfaces needing high-quality finishing, so that it can be made more economically; lastly conditions are to be created so that the press tool can be divided for the insertion of bulky hose fittings or other bulky workpieces.

The solution of this problem is accomplished according to the invention by the distinctive features of Claim 1. The series of problems is solved to the full extent by this solution. The core of the invention consists, simply expressed, in the fact that, from the beginning to the end of the press stroke, the press tool with all its pressing faces is so enclosed in the press yokes between the thrusting body and the other walls surrounding the press tool that there is no possibility of independent movements of the pressing faces due to uncontrollable reaction forces from the workpiece. Also the thrusting body itself, which spans the line of separation, is dependent exclusively on the movement of its controlling surfaces or slide surfaces in the press yokes. In principle the important thing is the rotation of the set of press jaws, known in itself, by 45 degrees in the press yokes. In the subject of the application, the central axis M moves laterally during the pressing action over half of the distance in the direction of the press gap while the thrusting body moves on, all the way in the direction of the press gap. This entire distance is precisely as great as the vertical path of the supporting body during the actual pressing procedure. This procedure guarantees that the free play or looseness between the press parts involved in the pressing action is minimized, and despite the great pressing forces the fittings pressed onto the hoses remain circular in cross section. This result cannot be achieved in the state of the art, since in the latter press rams are arranged on the left and right of the pressing plane, while in the case of the invention a moving thrusting body is present on only one side.

This reduction of the possible free play guarantees retention of roundness in the final product, even in the case of hoses for very high pressures, e.g., above 1000 MP, in which corresponding wall thicknesses of the inserted fittings are shaped onto the high-pressure hoses.

Since the thrusting body is arranged on only one side of the press tool, the possibility is created for forming fittings onto high-pressure hoses when they have, for example, a coupling tube with a 180 elbow.

As a result of the further development of the invention, it is additionally advantageous if the press tools consisting of two tie bars are arranged on one side of a press frame, and the center of gravity of the area of the second slide faces in the press yokes, which are arranged together in a wedge shape, on the other side of the press frame. If the virtual bilateral lever arms thus formed are at least substantially of equal length, the flexural moments acting contrarily on the tie bars at least substantially cancel one another, so that the friction forces are also reduced and the entire design can be more easily executed, including the drive.

Additional advantageous embodiments of the invention result, either individually or in combination, from the subordinate claims.

The following advantages in sum are the result:

1. The press design makes possible a lateral free space for the later insertion of very tightly bent, more complex fittings with bend angles of over 90 degrees.

2. The press tool itself occupies but a narrow, disk-shaped space which is freely accessible from in front, from behind and from the side.

3. All pressing faces, whether on the support bodies or on separate press jaws are locked together during the pressing action, so that an absolutely round product is achieved.

4. The pressing force applied by the drive or its reaction force can be introduced directly into the press frame or press tool without harmful bending moments.

5. The pressing tool is divisible and can be opened as wide as desired.

6. The invention also permits the pressing of hoses with common commercial pipe elbows in which R=d, "R" being the bend radius and "d" the outside diameter of the tube.

7. The first slide and/or supporting faces for the supporting bodies form a control quadrilateral whose sides are parallel and perpendicular to the direction of the force, and which—in the case of a perpendicular arrangement—is not "inverted."

8. The pressing tool can be used in any position.

Additional advantages appear from the following description.

The bulk of the literature and the radial presses with press yokes and press tools made accordingly in practice disclose press jaws and/or supporting or controlling bodies for them, whose virtual envelope surfaces form a square whose one surface diagonal lies in the dividing line between the press yokes or runs parallel thereto. The square is sort-of "inverted." But now the ratio of the length of the surface diagonals to the edge length is 1.41. This has the decided disadvantage that, assuming that the press tool is divisible, after lateral insertion only U-shaped metal fittings or their tubes can be pressed onto high-pressure hoses in which the radius of curvature is appropriately large on account of the length of the surface diagonals.

But tightly bent 180-degree elbows of complex shape with additionally attached branch lines are gaining importance, e.g., for construction machinery such as power loaders with numerous moving components. The said fittings sometimes look like antlers! After-welding is impossible, so heretofore recourse has been had to a greater number of threaded connections which have to withstand high pressures and external stresses by bending.

Another decided disadvantage is that the press jaws and/or the supporting or control bodies for them lie on control surfaces which are set for the said square and which are simultaneously slide surfaces for the press jaws and/or their supporting or control bodies. On these slide surfaces the press jaws and/or the support or control bodies perform peculiar movements which sometimes are desired by the operators of the press but sometimes they are also affected by the reactions of the workpieces. The problems increase all out of proportion with the wall thickness of the workpieces, which as a rule are thick-walled nipples of high-strength automatic screw steel. The consequences are useless out-of-round or oval products. The outcomes are not foreseeable.

Embodiments of the invention and their manner of operation are further explained below with the aid of FIGS. 1 to 13; FIG. 14 shows for comparison a radial press of the state of the art.

BRIEF DESCRIPTION OF THE FIGURES

In FIG. 1 a radial press 1 having two press yokes 2 and 3 is represented, which can be driven relative to one another in the direction of a plane E—E in which lie also the axes A1 and A2 of two tie bars shown in FIGS. 11, 12 and 13. This plane is perpendicular to the plane of drawing of FIG. 1. Pressing forces are produced by a drive to be shown later. The press yokes 2 and 3 have recesses 4 and 5 in mirror-image relationship, which are covered at least partially with self-lubricating coverings 6 and 7 and therefore they form slide surfaces. The first slide surfaces 6*a* and 7*a* run parallel to one another and to the dividing line T, but perpendicular to plane E—E. On these first slide surfaces 6*a* and 7*a* lie, as seen clockwise, four supporting bodies 8, 9, 10 and 11 which bear the pressing surfaces 8*a*, 9*a*, 10*a* and 11*a*, which are configured as sectors of a cylindrical surface corresponding to the final surface of the workpieces to be pressed. The said supporting bodies form a set 14 of press jaws.

On the sloping slick surface 7*b* lies a symmetrically shaped wedge-like ram 12 with two slick surfaces 12*a* and 12*b* whose included angle "α" corresponds to that of the slick surfaces 6*b* and 7*b*. If the press yokes 2 and 3 are closed in a no-load stroke "L" the system first arrives as the position shown in FIG. 2. This takes place at least largely without force. A bevel 12*c* on the ram 12 prevents any collision of the supporting body 11 with the ram 12 during the closing action. Also the face 12*d* of the rain 12 is formed by an anti-friction cover 12*e*.

Figure 1:
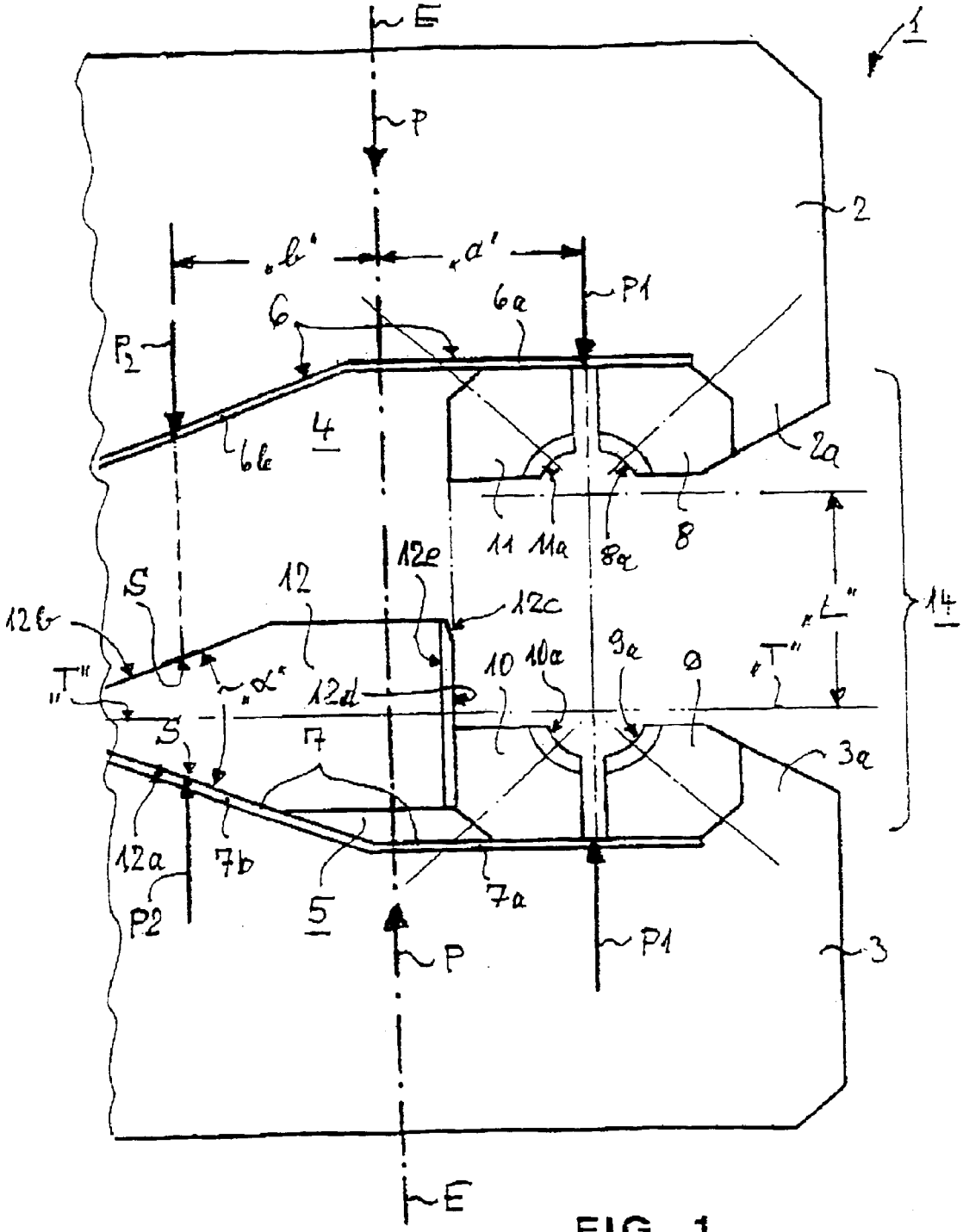
FIG. 1 is a front elevation of two press yokes with a pressing tool having four pressing faces and a symmetrical ram in the maximum open position.
Figure 2:
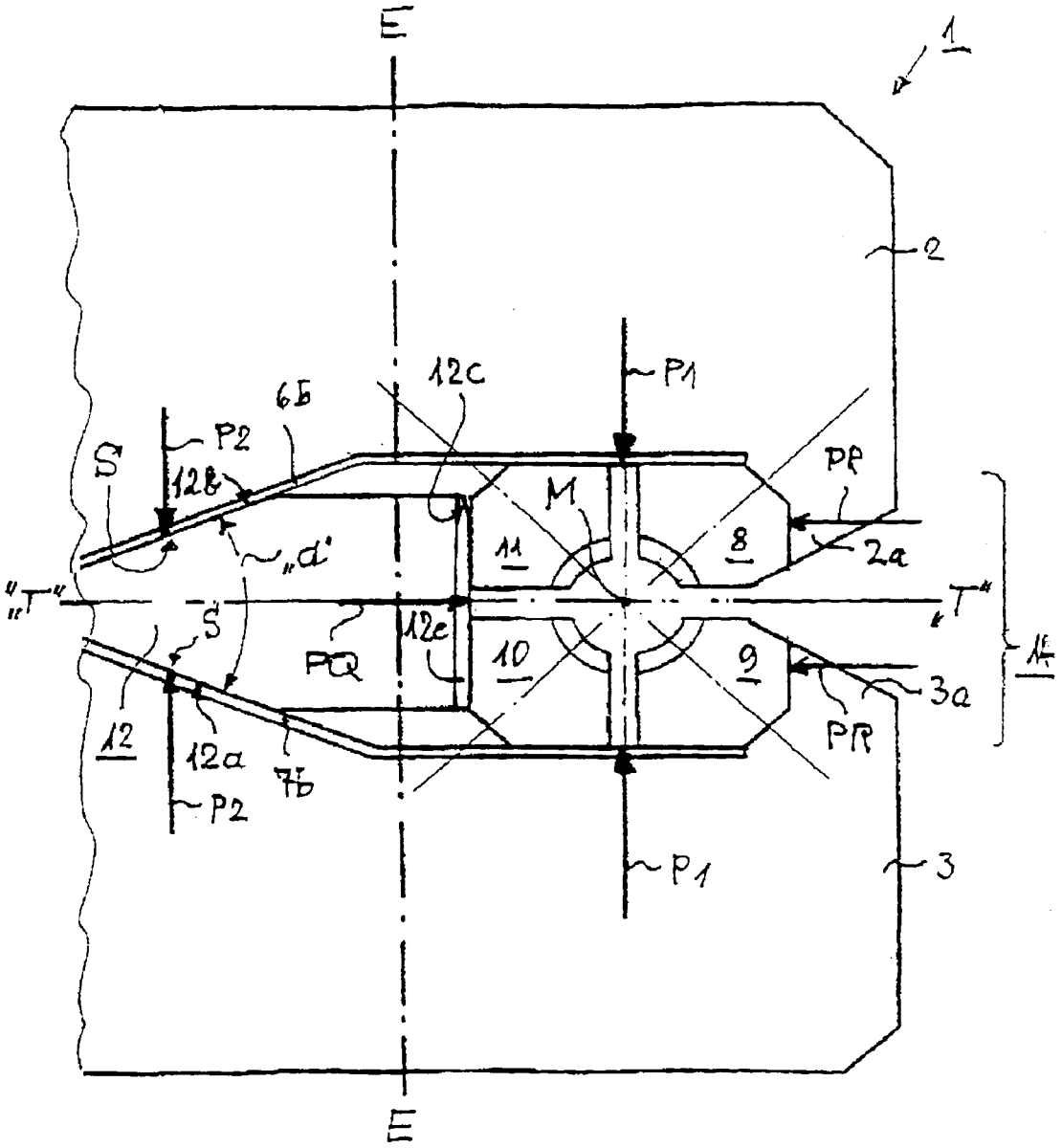
FIG. 2 a view similar to FIG. 1, but after completing the linear idle stroke of the press tool.
Figure 3:
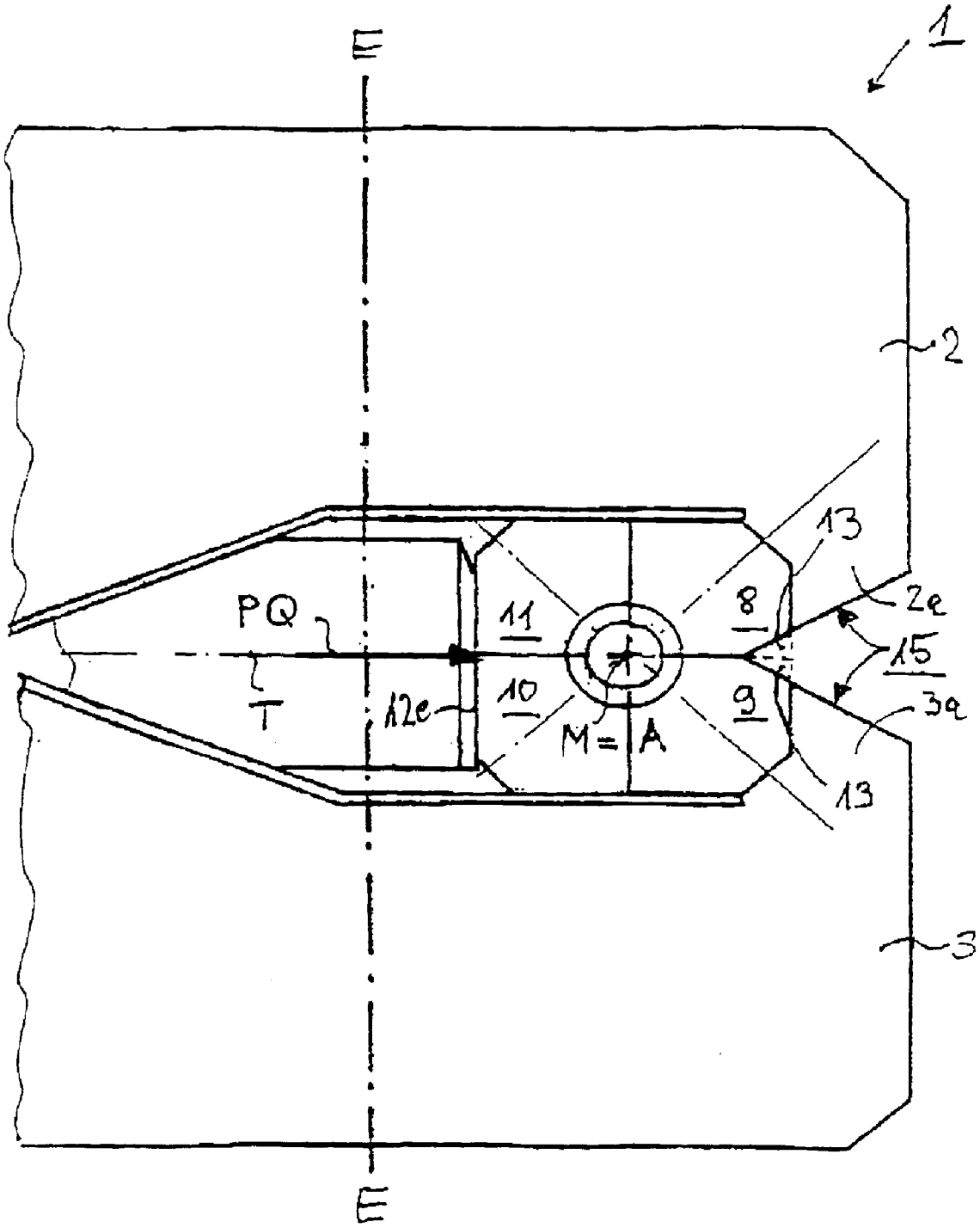
FIG. 3 a view similar to FIG. 2, but with the press tool at the end of the radial travel of the pressing surfaces.

If the system described moves from the position of FIG. 2 to that of FIG. 3, the pressing forces P1 and P2 increase enormously, and the slick surfaces 6*b* and 7*b* force the ram 12 at its upper face 12*d* (FIG. 1) in the direction of the plane of separation T against the supporting bodies 10 and 11, thereby producing a transverse force PQ. The reaction forces PR (FIG. 2) are produced by overlapping projections 2*a* and 3*a* on the press yokes 2 and 3. The pressing and reaction forces distributed on the circumference of the press jaw set 14 are at least largely identical. The movements of the supporting bodies 9/10 on the one hand and 8/11 on the other hand against one another in the direction of the tie bars are necessarily identical, on account of the choice of angle "α" of 53 degrees and 8 minutes (rounded), with the movements of the supporting bodies 10 and 11 against the supporting bodies 8 and 9 in the direction of the plane of separation T, so that an absolutely synchronous movement of all supporting bodies takes place during the pressing operation.

FIG. 3 shows the end position of all supporting bodies at the end of their radial pressing movements, in which the supporting bodies abut one another seamlessly. It is obvious that in this case the workpiece axis "A" is shifted in the direction of the plane of separation T by one-half of the press stroke, but this has no effect on the pressing results. The central axis M of the pressing faces coincides in the end position with the workpiece axis A.

Back to FIG. 1. The pressing forces P2 attack so-called surface points of gravity S of the slide surfaces 12*a* and 12*b* of the ram 12, which is shown especially clearly in FIGS. 1 and 2, but applies equally to the embodiments shown in the other figures. The center points of the forces of action by the pressing forces P1 on the press jaw sets 14 and 16 are at a distance "a" from the plane E—E, and the surface points of gravity S of the forces of action of the press forces P2 are at a distance "b" from the plane E—E on the opposite side, "a" being made equal to "b" to special advantage. Thus all bending moments fall, aside from slight changes of "a" and "b" during the pressing, on the tie bars in the plane E—E, so that the tie bars 40,41 (FIGS. 11 to 13) are kept thinner and can be designed to a great extent only for tension forces. The forces of friction on the tie bars are thereby drastically reduced and any tilting of the supporting bodies against one another is eliminated, leading to an appreciable reduction of the total weight of the radial press 1.

The tie bars 8 and 9 are bolted to the press yokes 2 and 3 (FIGS. 5, 11 and 12), but they can also be made integral with the press yokes 2 and 3, so that the parallel slide surfaces 6*a* and 71 can be kept shorter accordingly.

Figure 7:
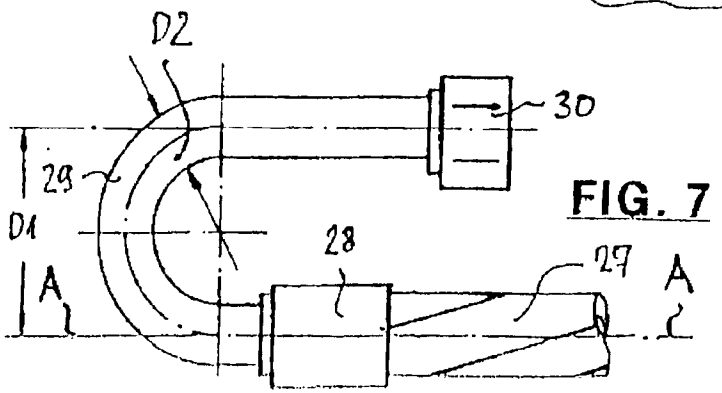
FIG. 7 the end of the high-pressure hose line with the hose fitting pressed on and a 180 degree tube elbow with a terminal nipple.

Especially advantageous in this case is the V-shaped gap 15 between the projections 2*a* and 3*a* on the press yokes 2 and 3. This gap 15 allows the insertion of tightly bent hose connections as represented in FIG. 7. In a prolongation of the defining surfaces of gap 15, the corners 13 of the supporting bodies 8 and 9, which are remote from the plane E—E, also are removed (see also FIG. 3).

The heart of the invention consists in including the supporting bodies and the pressing surfaces connected with them within a rectangular or square space such that, under the effect of the reaction forces of the workpiece they are unable to perform any uncontrolled yielding from the precisely radial synchronous movement.

This applies also to the following additional embodiments of the invention.

Figure 4:
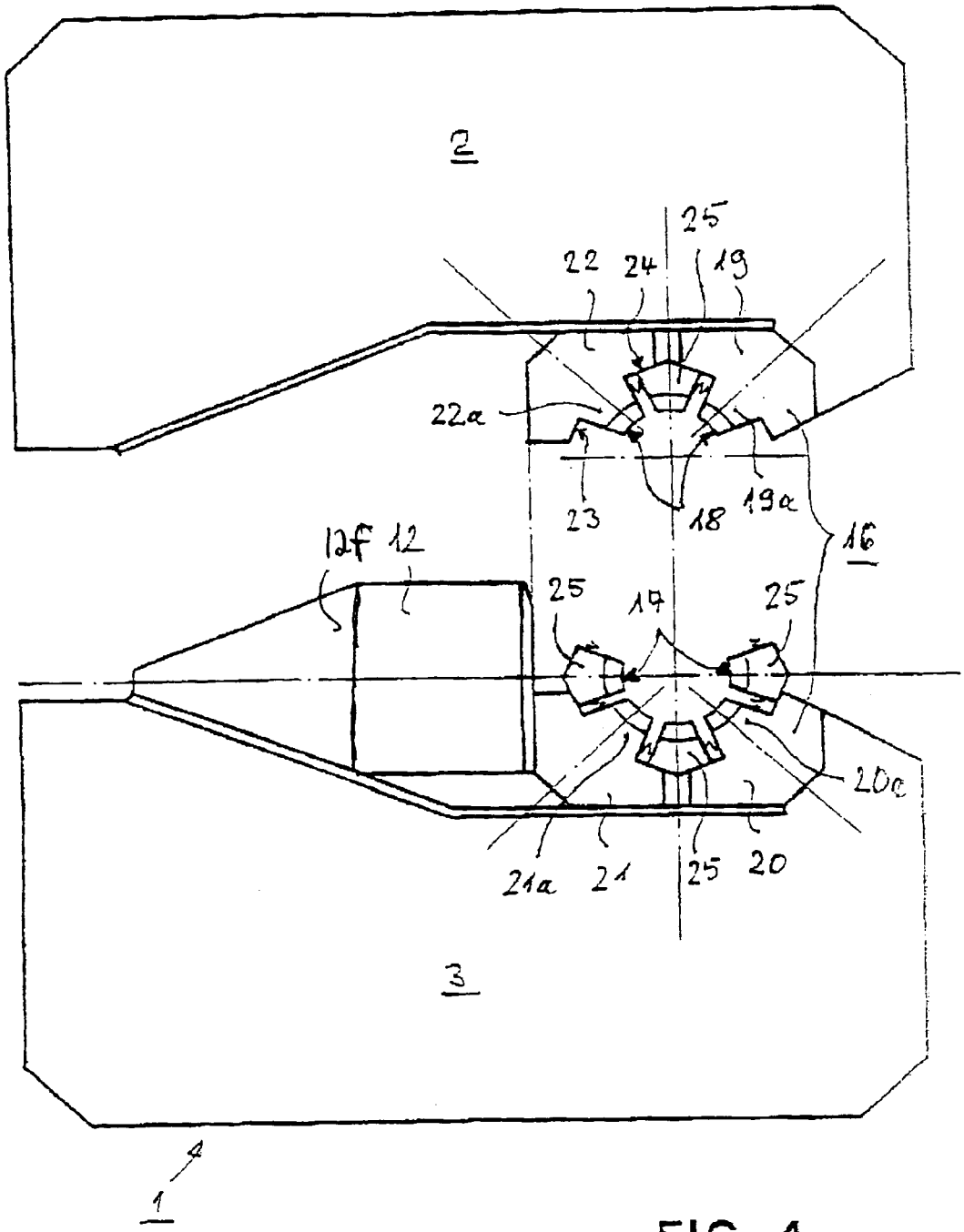
FIG. 4 a view similar to FIG. 1, but with a variant press tool of eight pressing faces FIG. 5 a view of the subject of FIG. 4 after completing the linear idle stroke.

FIG. 4 shows, in a manner similar to FIG. 1, a press jaw set 16 containing eight radially movable pressing surfaces 17 and 18. First, four supporting bodies 19, 20, 21 and 22 are again present, but they have a projection 19*a*, 20*a*, 21*a* and 22*a* formed on them in the inside center, which includes an angle of 45 degrees, and each bearing one of four pressing faces 18. On either side of the projections of all supporting bodies there are two slide surfaces 23 and 24 which include an angle of 135 degrees. On these slide surfaces 23 and 24, between two adjacent projections 19*a*, 20*a*, 21*a* and 22*a*, lie four press jaws 25, each the same as the other, in an alternating arrangement with the projections. The distribution is so arranged that three pressing faces are on press yoke 2 and five pressing faces on press yoke 3. Further details will be found in FIGS. 5, 6 and 8.

Figure 5:
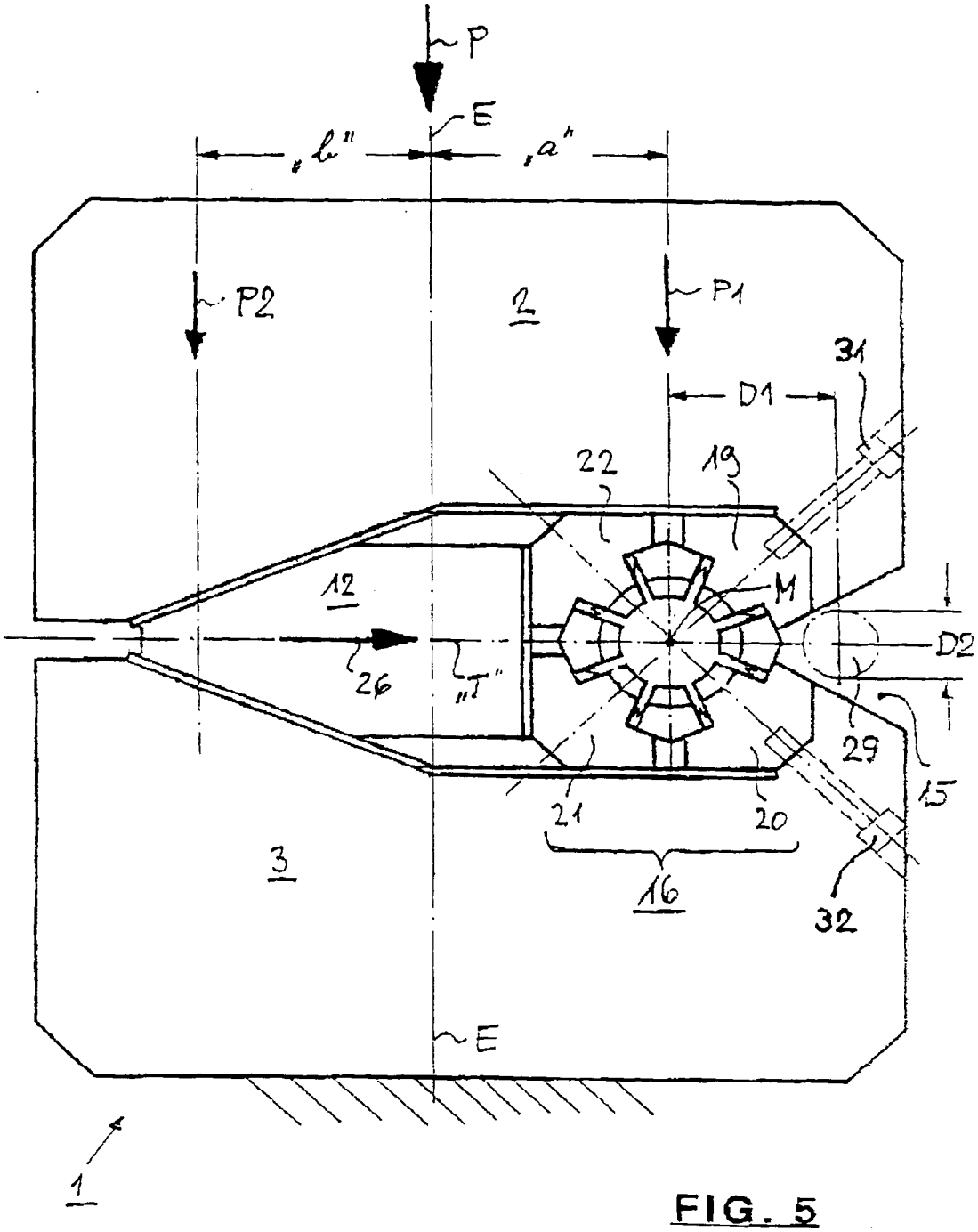

FIG. 5 shows a position similar to FIG. 2, i.e., the press jaw set 16 after completing the no-load stroke. If the press yokes 2 and 3 are now drawn further together, the supporting body 12 is driven in the direction of the arrow 26 until the supporting bodies and the press jaws have reached the position seen in FIG. 6. In prolongation of the defining surfaces of gap 15, the corners 13 of the supporting bodies 19 and 20, which are adjacent the plane of separation T, are also removed (see FIGS. 3 and 6). FIG. 5 also shows in what manner the gap 15 and the removed corners of the supporting bodies 19 and 20 permit the pressing of hose fittings having bends 29 with tight bend radii, as they are shown in FIG. 7. It is furthermore apparent from FIG. 5 that the supporting bodies 19 and 20 are removably bolted to the press yokes 2 and 3 by tension bolts 31 and 32 aligned at an angle to the press yokes 2 and 3; they can, however, also be made integral with these press yokes, which also applies to the embodiment according to FIGS. 1, 2 and 3.

Figure 6:
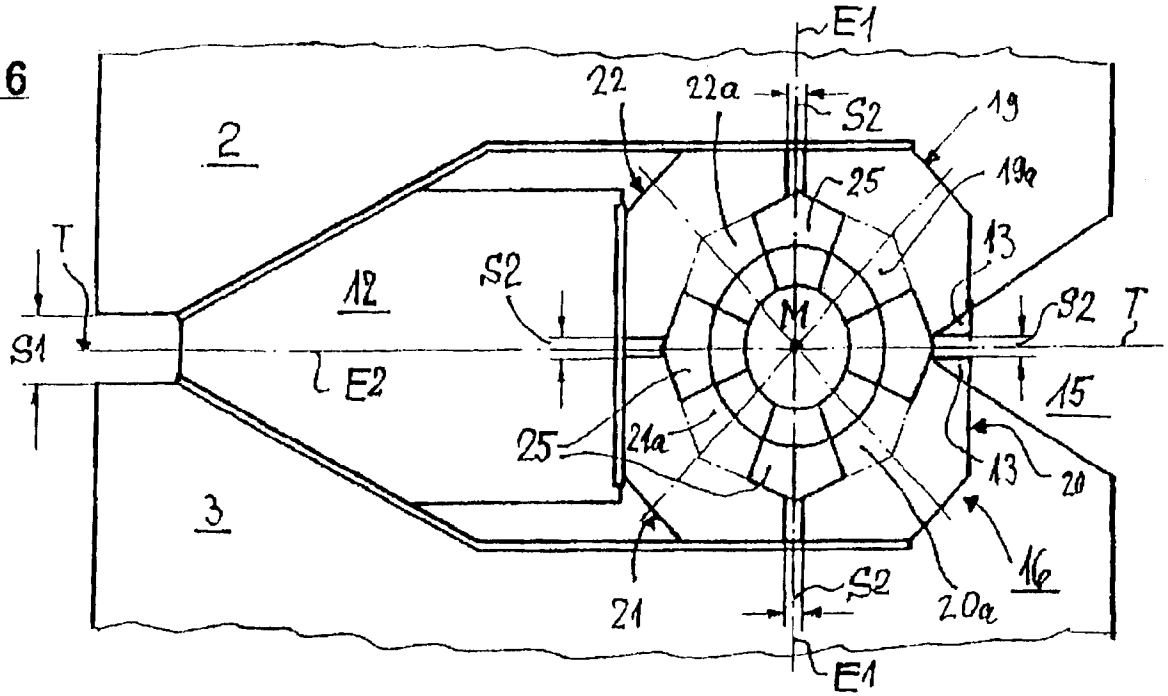
FIG. 6 an enlarged section from the center of FIG. 5, but with the press tool closed at the end of the radial pressing movement of the pressing faces.

FIG. 6 shows an enlarged section from the middle of FIG. 5, but with the press jaw set 16 closed at the end of the radial press motion. The projections 19*a*, 20*a*, 21*a* and 22*a*, and the press jaws 25 arranged alternately between them (see also FIG. 4) abut gap-free at radial lines of separation in which the press axis also lies. To avoid a mechanical redundancy, gaps S1 and S2 remain between the press yokes 2 and 3 on the one hand and the supporting bodies 19, 20, 21 and 22 on the other. Both these supporting bodies and the press jaws can be provided with replaceable sets 25*b* of jaws made of high-strength and hardened hollow cylinder sectors (See FIG. 8) which make up a closed ring. So that the press tool 16 will open again automatically after the press yokes 2 and 3 are relieved, pre-tensioned compression springs are disposed in the radial planes of separation and are only indicated in FIGS. 4 and 5, however.

FIG. 7 shows the end of a high-pressure hose 27 with hose fitting 28 pressed onto it and a 180 degree tubular elbow 29 with connecting fittings 30. The bend diameter D1 of the axis of the elbow 29 is relatively very small in proportion to the hose diameter D2.

Figure 8:
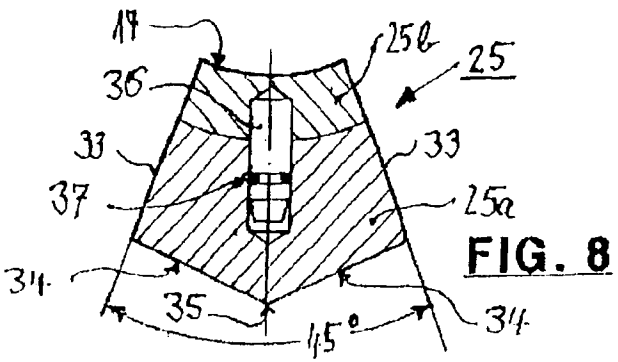
FIG. 8 a section from FIG. 6 on an enlarged scale.

FIG. 8 shows such a press jaw 25 of mirror-image symmetry enlarged more than FIG. 6, which has a base 25*a* and a press jaw attachment 25*b*. The two common radial external surfaces 33 enclose an angle of 45 degrees. Between these outside surfaces 33 are slide surfaces 34 which on both sides of an axially parallel edge 35 enclose an angle of 135 degrees and cooperate with the slide surfaces 23 and 24 of the supporting bodies (see FIG. 4).

According to FIG. 6, these slide surfaces 34, by means of the dash-dotted lines, make up a uniform octagon with corner angles of 135 degrees each, which is apparent from the drawing alone. Two oppositely lying edges 35 of two press jaws 25 lie in a first plane of symmetry E1 running parallel to the pressing direction P; two again opposite edges of the two remaining press jaws 25 lie in a second plane of symmetry E2 which coincides with the plane of separation T at the beginning and at the end of the press operation and runs perpendicular to the pressing direction P. The jaw 25*a* and its pressing face 25*b* are replaceably held together by a pin 36 which, being held tightly joined to the pressing face 25*b* by a locking ring 37 is frictionally held in the jaw 25*a*.

It is evident that the complete radial press 1 can be used in any available space, i.e., the pressing direction P can be vertical or horizontal. The following figures show embodiments with a vertical pressing direction P. This is a possibility also for all of the embodiments according to FIGS. 1 to 3 and 4 to 8 and 10.

Figure 9:
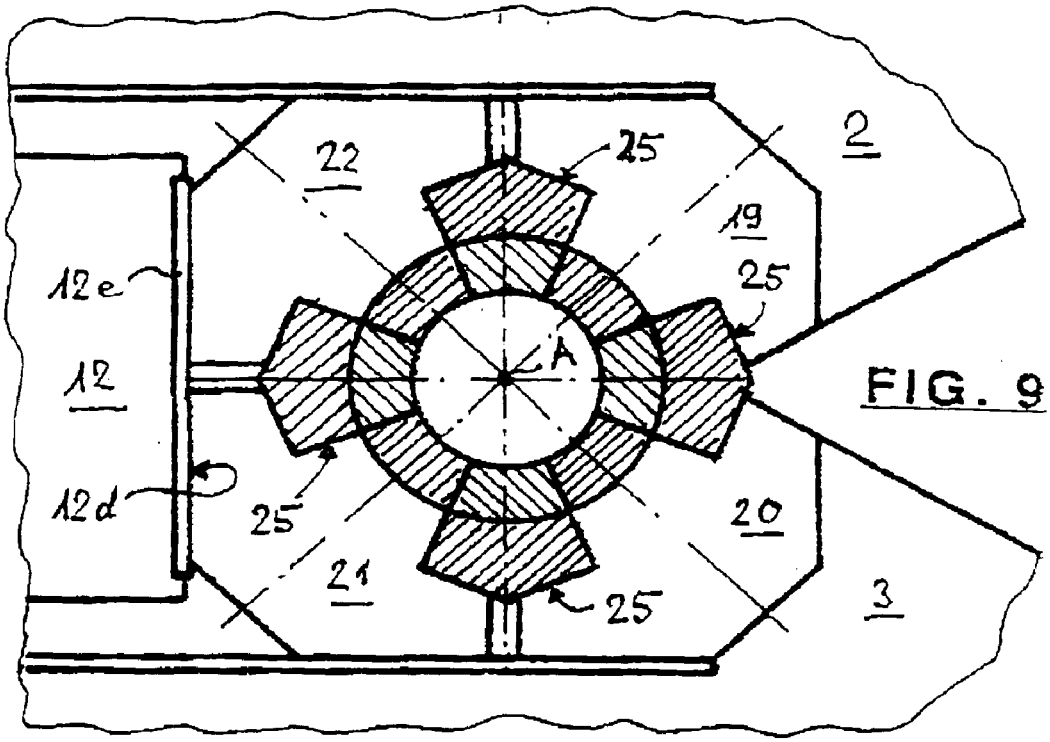
FIG. 9 an enlarged detail from the right half of FIG. 6 with four replaceable identical press jaws.

FIG. 9 shows, in harmony with FIG. 6, that both the supporting bodies 19, 20, 21 and 22 as well as the pressing jaws 25 (shaded) can bear press jaw facings which in the closed state including their press facings make up a ring which is represented by alternating shading on the circumference.

Figure 10:
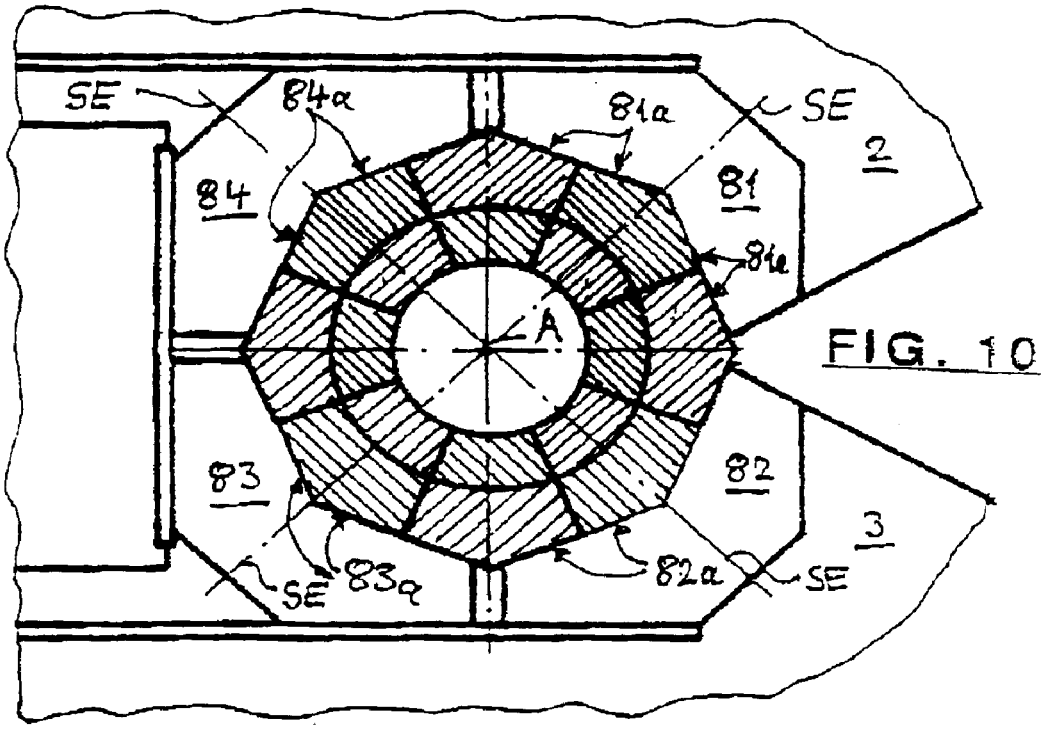
FIG. 10 a variant of FIG. 9 with eight repleaceable identical press jaws.

FIG. 10 shows that the projections 19*a*, 20*a*, 21*a* and 22*a* seen in FIG. 4 can be replaced by pressing jaws 25 as in FIGS. 8 and 9, shows that a crown of eight identical jaws 25 is formed as in FIG. 8. Thus, four angular supporting bodies 81, 82, 83 and 84 are formed with four pairs of supporting surfaces 81*a*, 82*a*, 83*a* and 84*a* which together enclose a regular octagon with corner angles of 135 degrees each. The four press jaws lying in the diagonal radial planes of symmetry SE are stationary on the supporting surfaces which guide press jaws arranged alternately between them during the press stroke. Due to this construction principle the manufacturing costs can be reduced.

Figure 11:
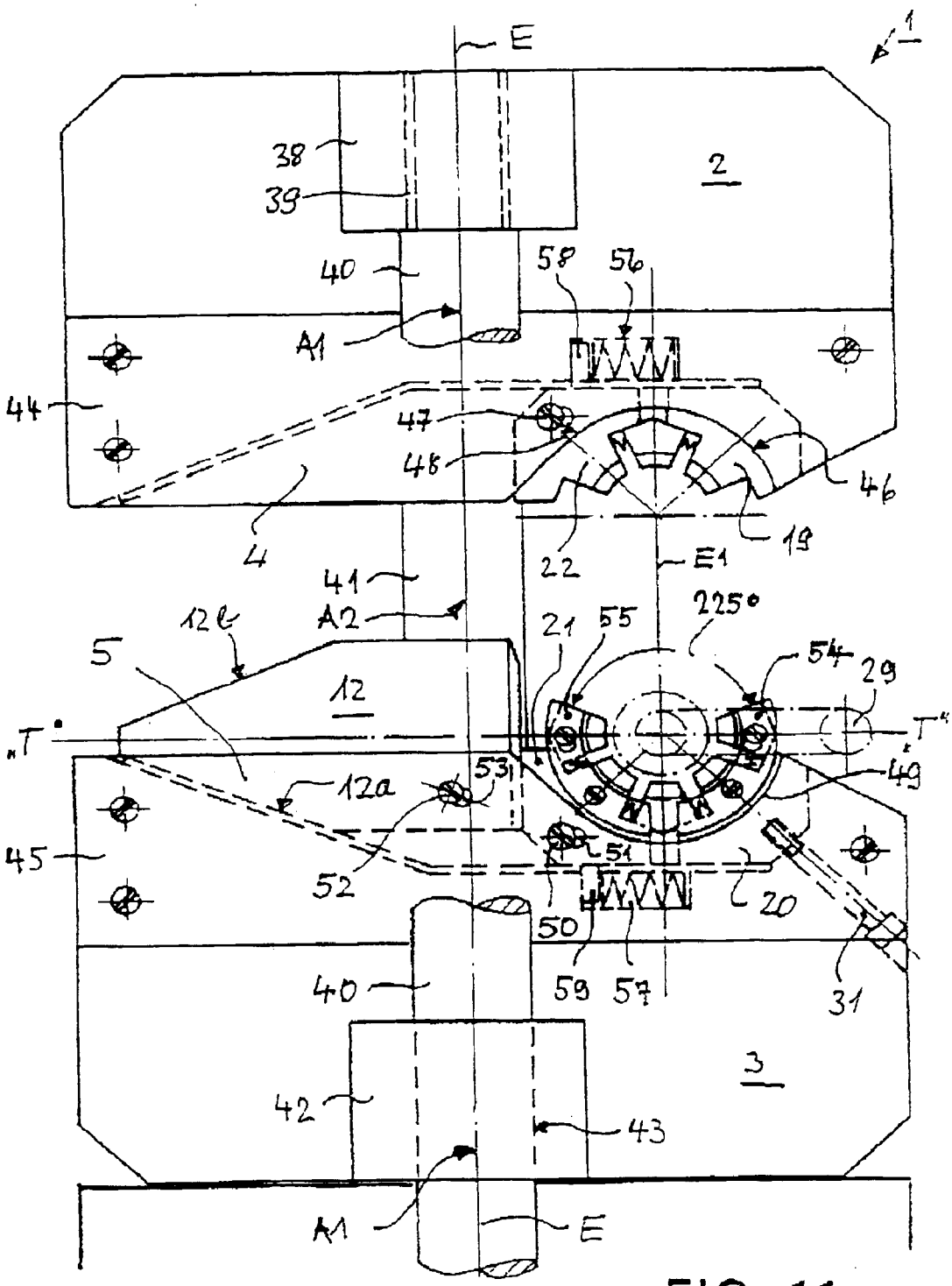
FIG. 11 a front elevation of an upright radial press with the details of FIG. 4 and a symmetrically angled pressing body.
Figure 13:
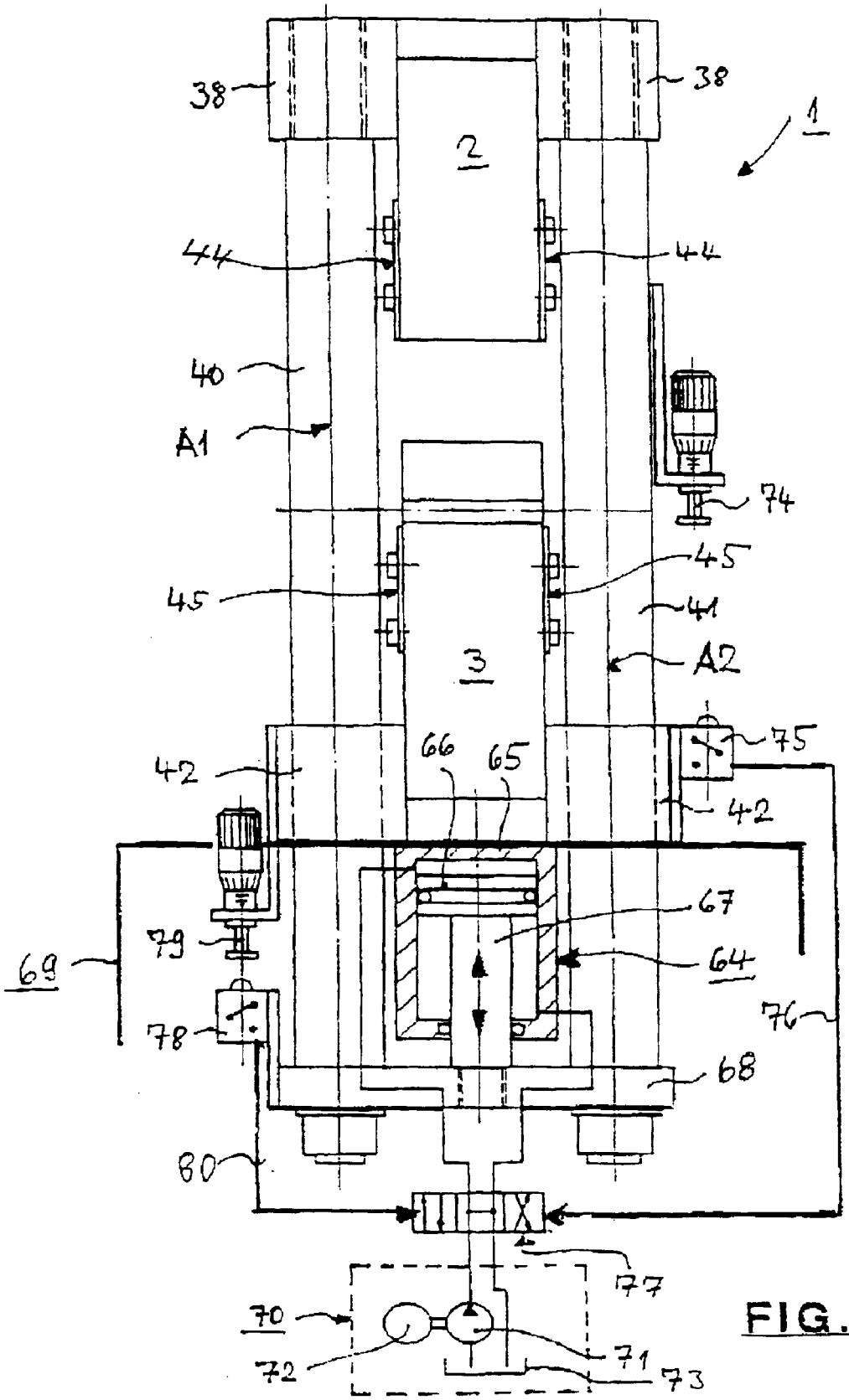
FIG. 13 a side elevation of the radial presses of FIGS. 11 and 12 with additional details on the hydraulic drive.

FIG. 11 in conjunction with FIG. 13 shows a completion of that of FIG. 4: The upper movable press yoke 2 has one boom 38 on each side, each with an internal screw thread 39 into which a vertical tie bar 40 and 41, respectively, is threaded. The lower, fixed press yoke 3 likewise has a boom 42 on each side, each having a bore 43 by means of which the upper press yoke 2 can be raised and lowered by means of the tie bars 40 and 41.

Guide plates 44 and 45 are bolted onto both sides of the press yokes 2 and 3 and between them they have the cut-outs 4 and 5, and likewise the ram 12 when the radial press 1 is in the closed state. The upper guide plates 44 have each an arcuate cut-out 46 facing downward, in back of which the two upper supporting bodies 19 and 22 are arranged. The displacement of the left supporting body 22 is assured by a screw 47 in a horizontal slot 48.

The lower guide plates 45 have each an arcuate cut-out 49 facing upward, behind which the two lower supporting bodies 20 and 21 are arranged. The adjustment of the lower left supporting body 21 is provided for by a screw 50 in a horizontal slot 51. The ram 12 is guided in a slot 51 by a screw 52 and its long axis is at the same angle as the slide surface 12*a* of the ram 12. This prevents any unintentional tilting or lifting of the ram 12. Two sectors 54 and 55 are screwed one onto each of the two lower supporting bodies 20 and 21, leaving free an opening angle of 225 degrees and preventing the press jaws 25 from falling out.

The explanations of FIGS. 1 to 10 apply to the closing and pressing movements. It is to be added, however, that prestressed compression springs serve for the horizontal retraction of the supporting bodies 21 and 22, and they run parallel to the plane of division T and act each upon a vertical prolongation 58 and 59, respectively, provided on the supporting bodies 21 and 22. The expression "supporting body" covers the possession of their own pressing faces and/or the supporting of press jaws.

Figure 12:
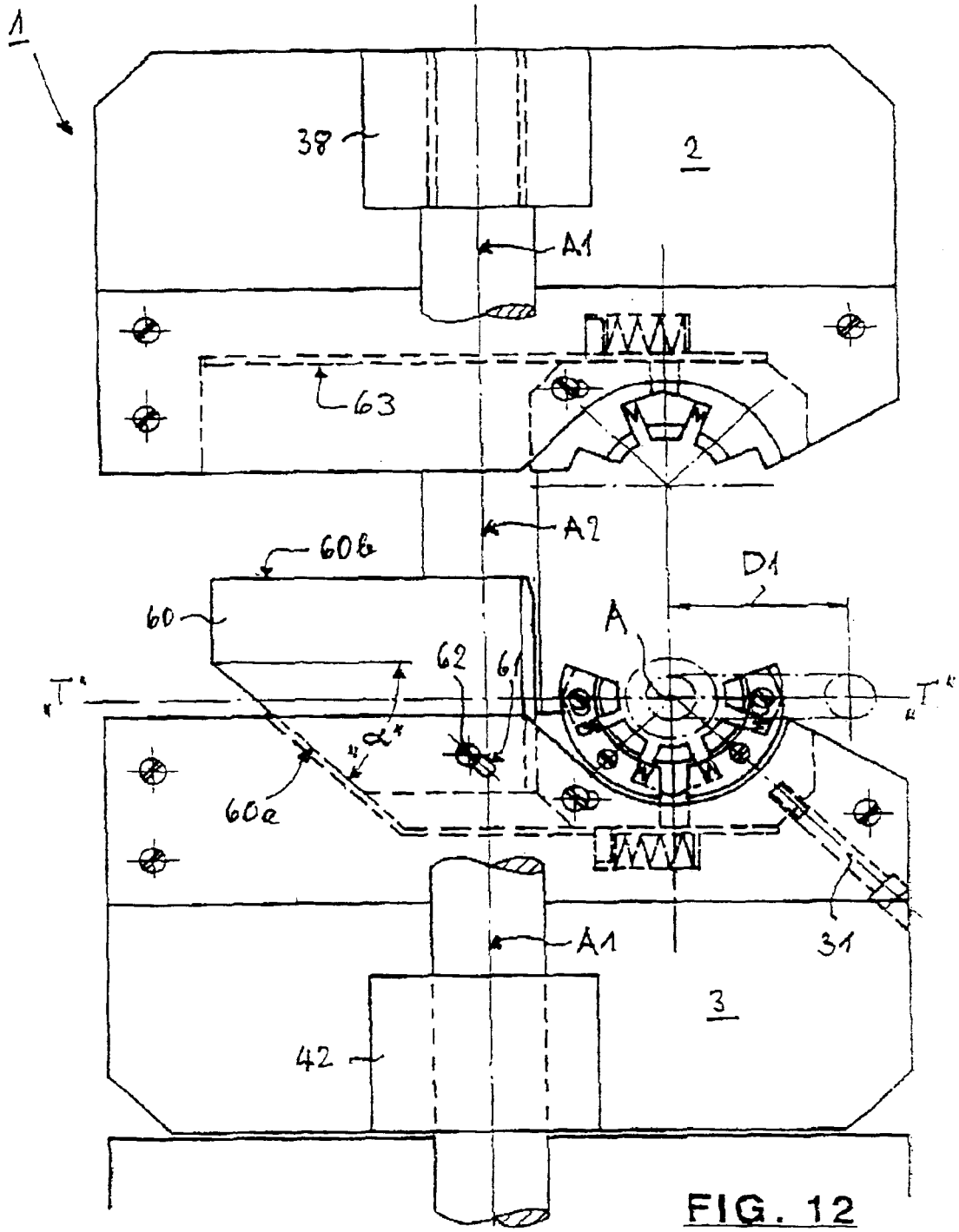
FIG. 12 a front elevation of an upright radial pressing body.

The subject of FIG. 12 thus differs from that of FIG. 11 in that here an asymmetrical press body 60 is used, whose slide face 60*a* is at an angle "α" of 45 degrees to the plane of separation T or from the horizontal. The same applies accordingly to the slot 61 under the screw 62. The upper slide face 60*b* of the ram 60 also is parallel to the plane of separation T the same as the slide face 63 in the upper press yoke.

FIG. 13 stands for FIGS. 11 and 12, each as seen from right to left. Special attention is here deserved by the press drive 64 and its control. A cylinder 65 urges a piston 66 against the lower press yoke 3, and its connecting rod 67 is screwed to a cross link 68 joining together the bottom ends of the tie bars 40 and 41. The lower press yoke 3 is placed upon a base structure 69. A hydraulic unit 70, consisting of a high-pressure pump 71, a pump motor 72 and an oil pan 73, is represented only schematically, since it is known in itself.

An adjusting screw 74 and a limit switch 75 are provided to limit the vertical travel of the upper press yoke 2. The final pressing diameter is here reached and the limit switch 75 sends its signal through a control line 76 to a control valve 77. After the action of this control valve 77 the oil flow from the high-pressure pump 71 goes to the annular face of piston 66 beneath it, in order to raise the cross link 68. This lifting movement is ended by the end limit switch 78 with the adjusting screw 79 and its signal is likewise delivered through a conductor 80 to the control valve 77. The radial press 1 is then back in its starting position according to FIGS. 9, 10 and 11.

Figure 14:
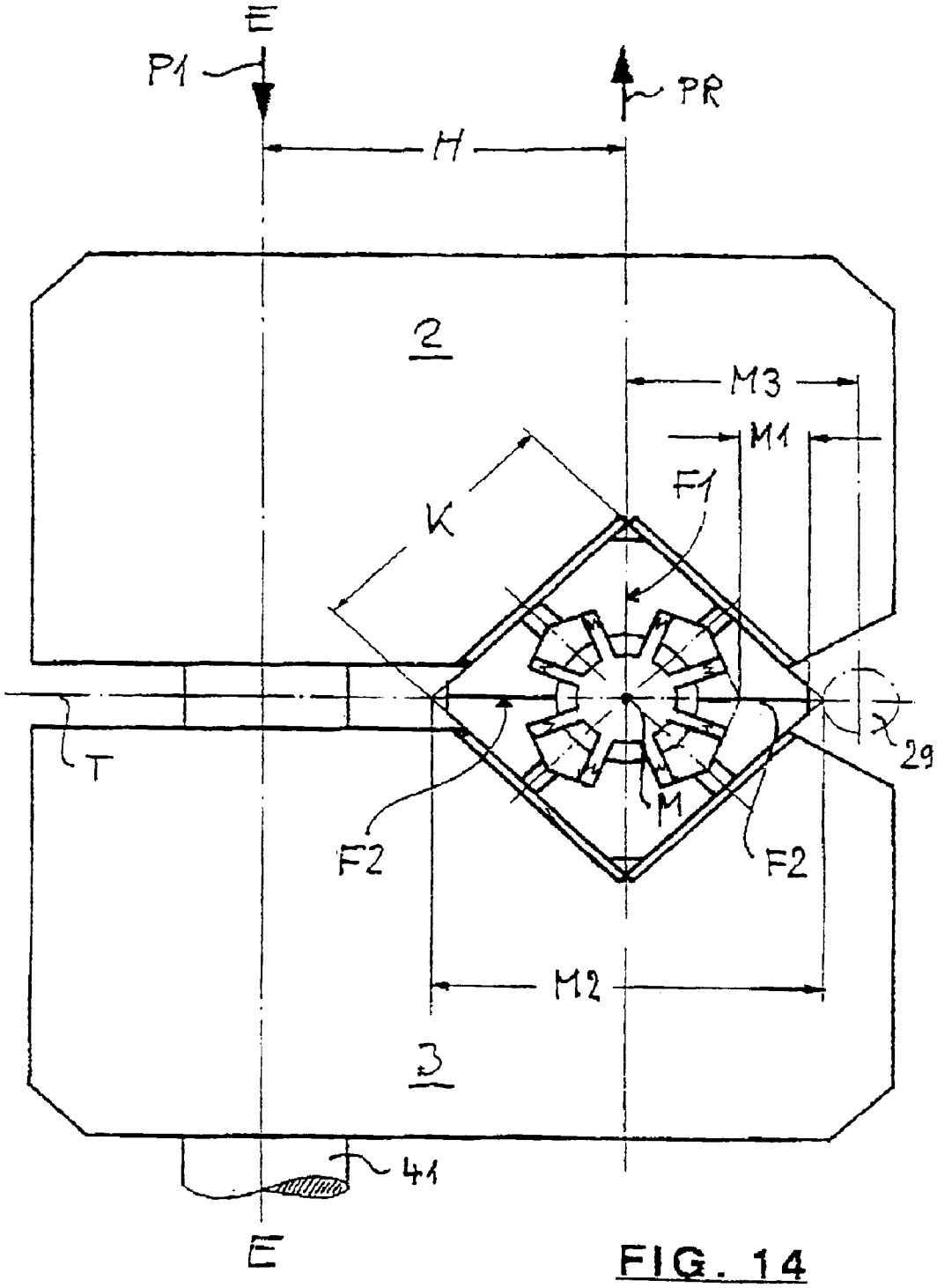
FIG. 14 a radial press according to the state of the art for purposes of comparison.

With the aid of FIG. 14 the state of the art and its disadvantages vis-a-vis the invention are explained as follows:

In contrast to the invention, the quadrilateral or square with the side length K, in which the guiding or sliding faces lie is somewhat "on one corner," i.e., the diagonal faces F1 and F2 of the press jaw insert are parallel and perpendicular to the plane E—E in which the tie bars lie. The surface diagonal F2 also coincides with the plane of separation T. Therefore the masses M1 and M2 increase at least 1.4-fold and thus also the mass M3 for the minimum distance of the axis of the elbow 29 from the central axis A of the press jaw insert, so that only elbows with a definitely greater bend radius can be worked. Especially disadvantageous, however, is the correspondingly great unilateral lever arm H between the press force P1 and the reaction force PR to which no counter-torque can be opposed. This in turn leads to high flexural torques which are exerted on the tie bars 41, so that their cross sections must be designed larger, resulting again in greater press weight. Furthermore, in the case of a divided press tool the supporting bodies must be divided along the diagonal surface F2, which would result in the elimination of the form closure and in cross shifting and out-of-round pressing results.

Despite all such measures only the pressing of hose fittings with a maximum nominal width of DN 16-4SP has been possible. Otherwise, presses closed on the circumference of the set of press jaws have had to be used, but they do not allow the pressing of fittings with complex geometries and bend angles greater than 90 degrees. Experience with such known radial presses open on one side have led to irregular, especially oval, pressing results, since the press jaws or faces can perform superimposed motions of their own due to the reaction forces produced by the workpiece. This signifies a great limitation of the use of the radial press. All of the disadvantages are now knocked out by a punch from the subject of the invention.

Whereas in FIGS. 1–6 and 9–12 the ram 12 is shown in unitary construction, however it is also possible to use a ram made of a combination of parts as far as it is guaranteed that these parts cannot move relative to dividing line T, e.g., as shown in FIG. 1. FIG. 4 shows ram 12 midline 12*f* which shows ram 12 made of two ram components operatively connected to form ram 12.

What is claimed is:

1. A radial press for pressing hollow workpieces, especially hose fittings, having a press frame with press yokes movable relative to one another, and a press drive with a given pressing direction (P) and a press jaw set forming a press tool with at least four pressing faces which, including their support bodies, are arranged for movement relative to a workpiece axis (A), the press yokes on both sides of a line of separation (T) perpendicular to the pressing direction (P) have each a recess with first slide faces on which at least two support bodies, are displaceably arranged, wherein a) the first slide faces for the displaceable support bodies are alighed parallel to one another and perpendicular to the pressing direction (P), the first slide faces forming a control quadrilateral, b) two of the support bodies lying opposite one another and displaceable in the direction of the parallel slide surfaces can be brought into active connection with a wedge-shaped ram movable parallel to the line of separation, the ram being mounted between two slide faces in the recesses, which enclose an angle "α" between them, and that the angle "α" is so chosen that the distance of the ram parallel to the line of separation (T) is of the same magnitude as the pressing path of the press yokes perpendicular thereto.

2. The radial press according to claim 1, wherein the angle "α" of the second slide surfaces and the aperture angle ("α") in a wedge-shaped ram of mirror-image symmetry amounts to 53 degrees and 8 minutes.

3. The radial press according to claim 1, wherein the angle "α" of the second slide surfaces in the case of a unilaterally wedge-shaped ram amounts to 45 degrees.

4. The radial press according to claim 1, wherein the press yokes are arranged between two parallel tie bars to which the one press yoke is fastened, that the other press yoke has guides for the tie bars, and that the central axes of the tie bars span a virtual plane (E—E) on one side of which the press jaw set is arranged and on its other side the second slide faces and at least a portion of the length of the ram are arranged.

5. The radial press according to claim 4, wherein the virtual plane (E—E) passing through the central axis of the tie bars is displaced at least so far toward the ram that the outer surfaces of the tie bars lie outside of a line of sight which passes through the opening between the pressing faces of the press jaw sets.

6. The radial press according to claim 1, wherein the central axis (M) of the press jaw set is parallel to the plane (E—E) and when the press jaw set (14,16) is in the closed position is at a distance "a" from the plane (E—E) and that the surface points of gravity (S) of the second slide faces have in this case a distance "b" from the plane (E—E), the distances "a" and "b" and thus the leverages acting on the tie bars are equal or nearly equal.

7. The radial press according to claim 1, wherein the support bodies have on their middle of their insides a projection formed thereon, each of which bears one of four pressing faces and is defined by two lateral surfaces which include an angle of 45 degrees, that on both sides of the projection a slide surface is disposed, being at an angle of 135 degrees to one another, and that between these projections four additional press jaws of identical shape are contained, alternating with the projections, such that the press jaw set has a total of eight identical pressing faces movable radially and synchronously.

8. The radial press according to claim 1, wherein the support bodies are of angular shape and have on their inner sides pairs of supporting surfaces which are at an angle to one another of 135 degrees and in the closed state lie on the edges of a regular octagon, and that on these supporting surfaces eight press jaws of the same shape are disposed, such that the press jaw set has altogether eight identical press surfaces movable radially and synchronously.

9. The radial press according to claim 1, wherein the slide surfaces of the support bodies lie within a virtual octagonal prismatic surface with edge angles of 135 degrees, two opposite edges of a par of press jaws lying in a first plane of symmetry (E1) which is parallel to the pressing direction (P), and two additional, oppositely lying edges of another pair of press jaws lie in a second plane of symmetry (E2) which is parallel to the line of separation (T).

10. The radial press according to claim 1, wherein the radial press has a divided press jaw insert.

11. The radial press according to claim 10, wherein the press yokes, have diverging angled slide faces set back from the line of separation (T) and diverging outwardly from the press jaw insert.

12. The radial press according to claim 10, wherein the press jaw set consists of two press jaw set parts each with a group of pressing faces of which the one group consists of three pressing faces and the other group of five pressing faces.

13. The radial press according to claim 12, wherein the press jaws are held on the support bodies of ring sectors and are guided for movement radially toward the workpiece axis (A).

14. The radial press according to claim 1, wherein the ram has in the direction of the line of separation a length that is greater than or equal to the diameter of a virtual envelope circle surrounding the support bodies.

15. The radial press according to claim 1, wherein the press has an upper movable press yoke and a cross link, which are joined together by tie bars, that the press drive is disposed in a base structure and acts upon the upper movable yoke through the tie bars.

16. The radial press according to claim 15, wherein the tie bars are brought through booms on both sides on the lower press yoke.

17. The radial press according to claim 1, wherein on the side of the press jaw set facing away from the ram a gap is formed which permits a free space for the insertion of pipe elbows with a band angle of more than 90 degrees.

18. The radial press according to claim 17, wherein the gap has a wedge shape diverting outwardly.

19. The radial press according to claim 17, wherein the press yokes have projections which overlap the press jaw sets on the side facing away from the ram and slant divergingly outward to form the gap.

20. The radial press according to claim 17, wherein the corners of the support bodies facing away from the ram are removed so as to form the gap such that the gap is thereby of outwardly divergent shape.

21. The radial press according to claim 17, wherein said ram is of unitary construction.

22. The radial press according to claim 17, wherein said ram comprising at least two parts.

* * * * *

UNITED STATES PATENT AND TRADEMARK OFFICE

CERTIFICATE OF CORRECTION

PATENT NO. : 7,043,806 B2
APPLICATION NO. : 10/925227
DATED : May 16, 2006
INVENTOR(S) : Peter Schrock et al.

It is certified that error appears in the above-identified patent and that said Letters Patent is hereby corrected as shown below:

On the title page item [73], correct as follows:

Change “Beteillgungen” with --Betelligungen--;

Change “Freidrich” with -- Friedrich--

Signed and Sealed this

Twenty-second Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,043,806 B2
APPLICATION NO. : 10/925227
DATED : May 16, 2006
INVENTOR(S) : Peter Schröck et al.

It is certified that error appears in the above-identified patent and that said Letters Patent is hereby corrected as shown below:

On the title page, item [73], correct as folows:

Change “Betelligungen” with --Beteiligungen--;

Signed and Sealed this

Second Day of January, 2007

JON W. DUDAS
*Director of the United States Patent and Trademark Office*